US005535694A

United States Patent [19]

Czipri

[11] Patent Number: 5,535,694

[45] Date of Patent: Jul. 16, 1996

[54] RETRACTABLE CLEAT WITH A SEALED HOUSING

[75] Inventor: John Czipri, Clearwater, Fla.

[73] Assignee: Accon Marine, Inc, Clearwater, Fla.

[21] Appl. No.: 531,468

[22] Filed: Sep. 21, 1995

[51] Int. Cl.[6] ..... B63B 21/04

[52] U.S. Cl. ..... 114/218

[58] Field of Search ..... 114/218, 219, 114/221 R, 230; 24/115 R; D8/356, 382; 410/55, 85, 96, 101, 102, 106, 107, 108, 110, 111

[56] References Cited

U.S. PATENT DOCUMENTS

| | | | |
|---|---|---|---|
| 1,299,529 | 4/1919 | Young . | |
| 2,729,417 | 1/1956 | Maynard | 114/218 |
| 2,870,733 | 1/1959 | Winther | 114/218 |
| 3,102,708 | 9/1963 | Crain . | |
| 3,126,859 | 3/1964 | Bigelow | 114/218 |
| 3,917,213 | 11/1975 | Poehlmann | 248/509 |
| 4,270,478 | 6/1981 | Kafka et al. | 114/218 |
| 4,672,909 | 6/1987 | Sweetsir | 114/218 |
| 4,809,634 | 3/1989 | Czipri | 114/218 |
| 4,820,094 | 4/1989 | Hirakui et al. | 410/107 |
| 4,890,566 | 1/1990 | Morris | 114/218 |
| 5,301,627 | 4/1994 | Czipri | 114/218 |

FOREIGN PATENT DOCUMENTS

| | | | |
|---|---|---|---|
| 747768 | 7/1980 | U.S.S.R. | 114/218 |

*Primary Examiner*—Stephen Avila
*Attorney, Agent, or Firm*—Harold D. Shall

[57] ABSTRACT

A cleat assembly with a cleat portion received in a housing which can be flush mounted on a boat. The lower portion of the housing is completely sealed and the cleat portion is received for vertical movement in the housing. The cleat portion has an upper exposed position and a depressed or flush position. Spring loaded poppits within the housing engage the cleat to maintain it in its upper and depressed positions.

2 Claims, 2 Drawing Sheets

RETRACTABLE CLEAT WITH A SEALED HOUSING

BACKGROUND OF THE INVENTION

1. Field of the Invention

This invention relates to boat cleats generally and is more particularly to a cleat which has a raised exposed operative position and inoperative position wherein it is depressed into a sealed housing.

2. State of the Prior Art

There are many types of retractable cleats but none of them are as strong and durable as the present invention while providing an integral housing for the cleat which is completely sealed to prevent water from leaking past the cleat and into the boat. U.S. Pat. No. 5,301,627 shows a strong retractable cleat, however the integral housing of the cleat is not sealed and water can leak therethrough so that a separate plastic cup, surrounding the housing, is installed to prevent leaking into the boat.

SUMMARY OF THE INVENTION

The present invention provides a cleat assembly including a sealed housing or base, and a cleat slidally mounted within the housing. A cross pin carried by the housing limits upward and downward movement of the cleat and a spring loaded poppit, carried within the housing alternately engages spaced detents on the cleat to resiliently releasably hold the cleat in its upper or lower position.

DETAILED DESCRIPTION

Figure 1:
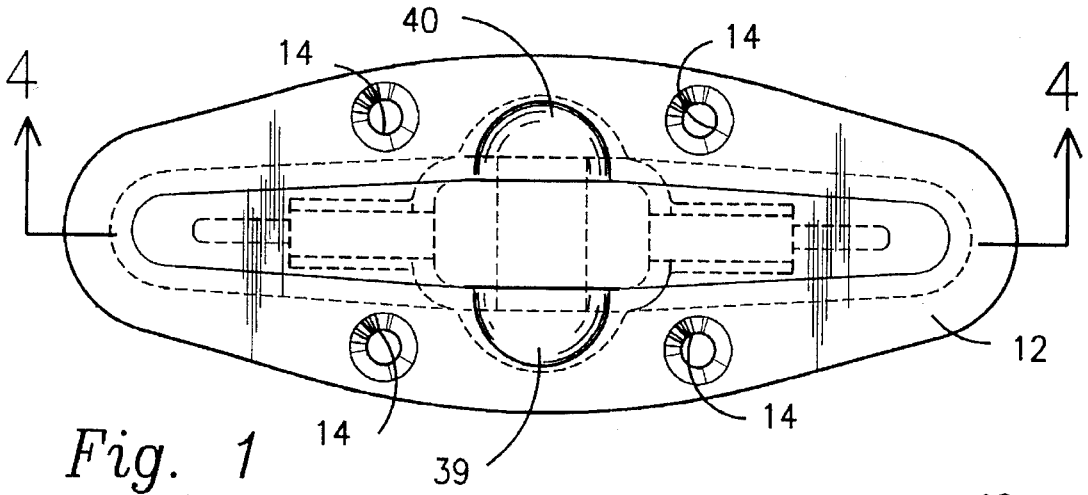
FIG. 1 is a plan view of this invention with the cleat in its depressed or flush position in the sealed housing.
Figure 2:
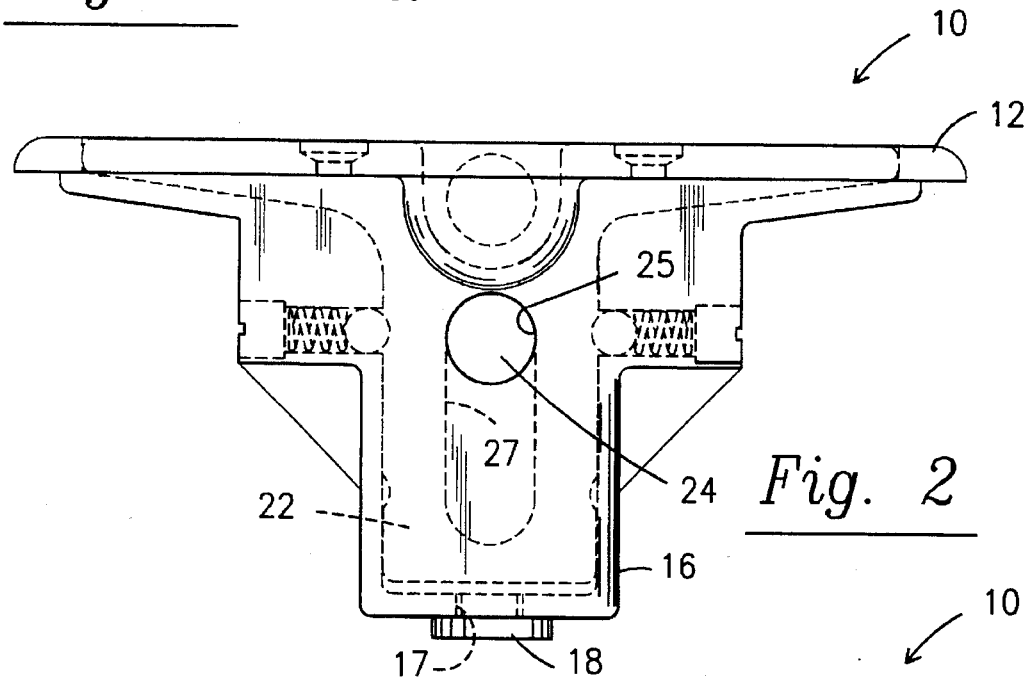
FIG. 2 is a front elevational view of this invention with the cleat in its depressed position.

Referring now to the drawings, a cleat assembly is shown at 10 and includes a flanged base plate 12 adapted to be secured to a suitable location on a boat by a plurality of screws passing through countersunk openings 14 in the base plate. Formed integrally with the base plate 12 and depending therefrom is a housing 16, which housing is completely sealed whereby any water (or other liquid) coming into the housing will not pass through the housing and into the boat. A threaded opening 17 provided in the base of the cleat so that (in the event the cleat is used as a lift cleat and must be extremely strongly mounted to the hull of the boat) a bolt (not shown) may be threaded into the opening 17, sealing the opening, with the distal end of the bolt secured in the hull. In the absence of a bolt, a plug 18 is sealingly secured in the opening 17.

Figure 3:
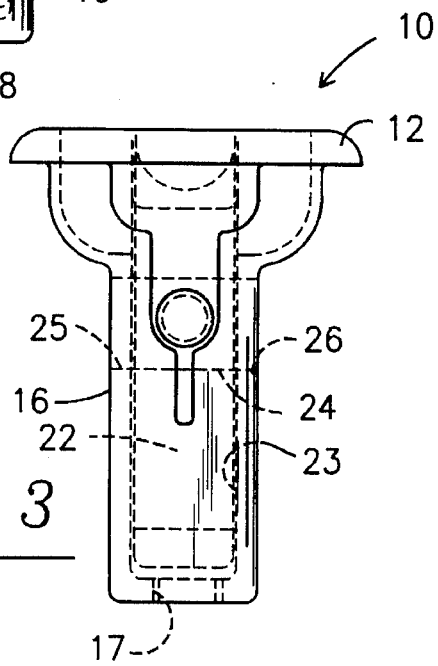
FIG. 3 is a side elevational view of this invention with the cleat in its depressed position.

A cleat 20 has a conventionally shaped top securing portion 21, to which a line may be secured, and a shank 22 extending downwardly from the securing position into the housing 16. The shank 22 and the bore 23 of the housing receiving the same are closely fitted as seen in the drawings, with their shape being such that no rotational or lateral movement can take place between the same while the cleat 20 may move vertically relative to the housing 16. A sturdy cross pin 24 is sealingly and securely pressed into aligned openings 25 and 26 (see FIG. 3) formed in the opposed sides of the housing 16. The laterally extending cross pin 24 is slidingly received in a vertically elongated and latterly extending slot 27 formed medially in the shank 22, with the opposed ends 28 and 29 of the slot being engagable with the pin 24 to limit, respectfully downwardly (see FIG. 4) and upward (see FIG. 5) movement of the cleat 20 within the housing 16.

Resilient means are provided to resiliently maintain the cleat 20 alternately in its flush (FIG. 4) and raised (FIG. 5) positions. More particularly, a pair of axially opposed openings 30, and 31 are formed in the housing 16 and in each of the openings is a poppit 32 resiliently loaded by a spring 33 and biased thereby axially inwardly of the housing 16 to engage cooperating detents in the shank 22. Into the outer ends of each of the openings 30 and 31 is sealingly and threadly received a screw plug 34 to serve as a seat for the springs 33 and to seal the outer end of the openings 30 and 31.

Figure 4:
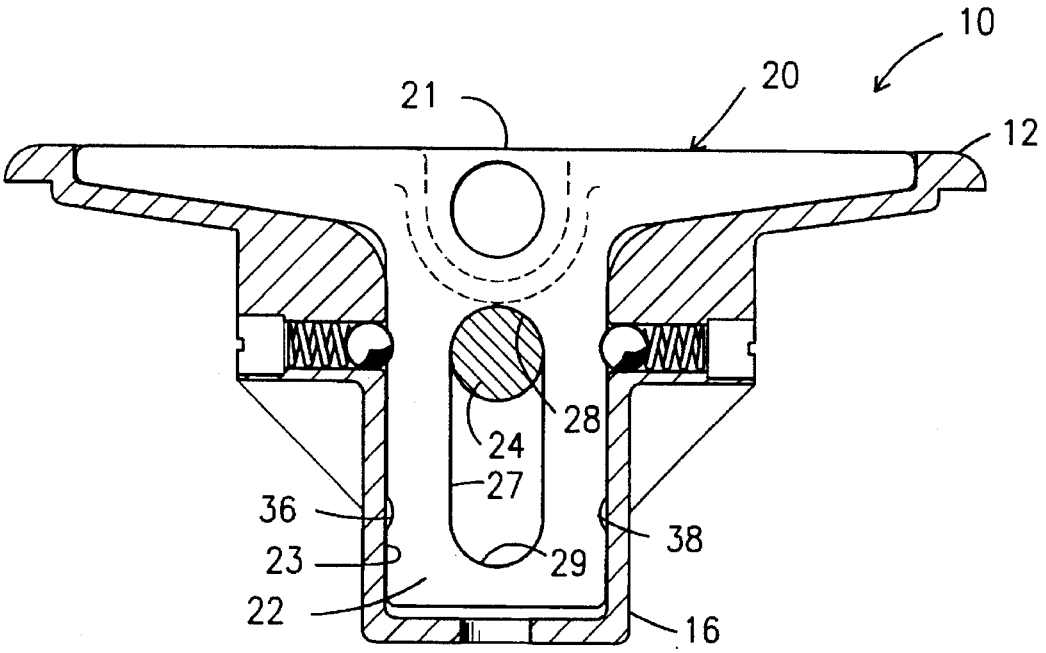
FIG. 4 is a sectional view taken along the line 4—4 in FIG. 1 with the cleat and spring loaded poppits shown in full lines.
Figure 5:
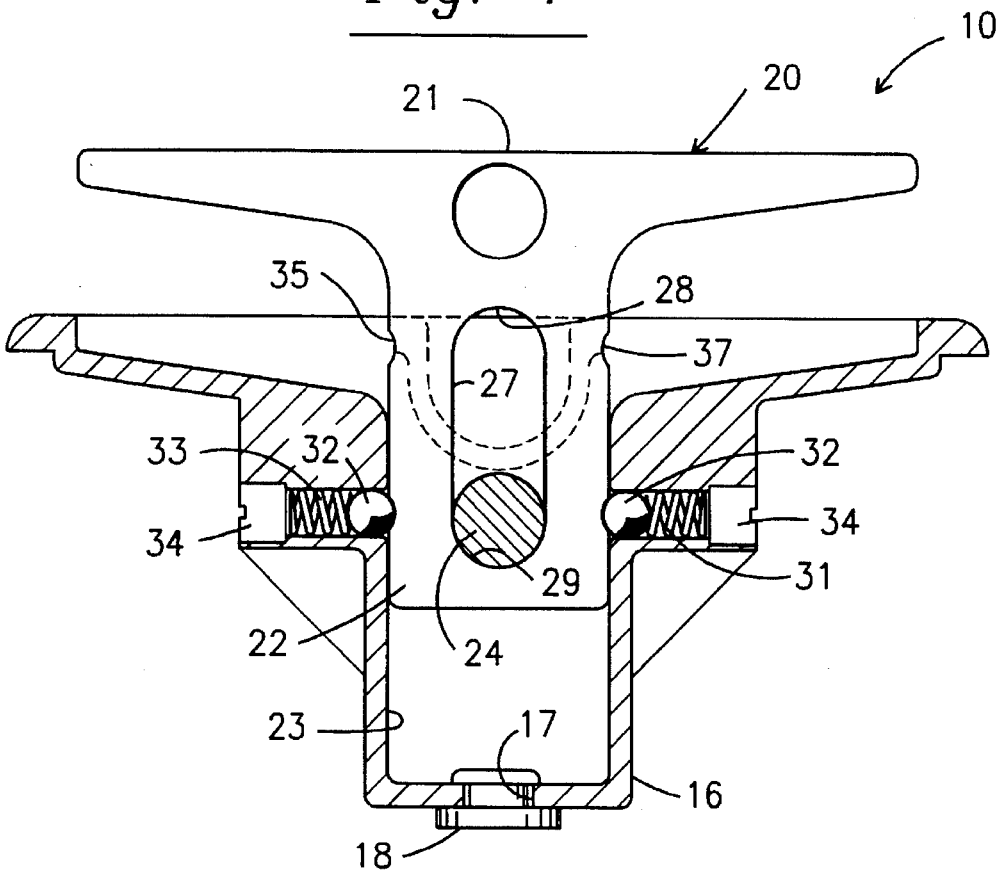
FIG. 5 is a view taken like FIG. 4 with the cleat in its raised position.

As most clearly seen in FIGS. 4 and 5, the shank 22, on its left side, has an upper detent 35 and a lower detent 36 and on its right side, has an upper detent 37 and a lower detent 38. When the cleat 20 is in its lower position, the poppits 32 are resiliently disposed in the detents 35 and 37, and when the cleat 20 is in its upper position, the poppits 32 are resiliently disposed in the detents 36 and 38. The poppits 32 thus alternately hold the cleat in its upper and lower positions and resiliently restrain the cleat from rattling in the housing 16. While a pair of opposed poppits are shown, it should be understood that a poppit on one side only will suffice. The cleat 20 is manually moved between its upper and lower positions. When in its lower position, it is flush so that the cleat does not provide an obstruction on the boat, while when raised, it is positioned to conventionally operate as a cleat. To assist in raising the cleat from its flush position, access slots 39 and 40 are formed in the base plate 12 so that fingers can be placed in such slots to grasp the securing portion 21 of the cleat 20 and raise the latter to its exposed position.

Although the foregoing description relates to a presently preferred embodiment, modifications can be made therein without departing from the scope of this invention as defined in the following claims.

What is claimed is:

1. A retractable boat cleat assembly having a lower depressed position and an upper exposed position and being moveable between such positions comprising;

a) a base plate having a flange with countersunk openings to receive screws for securing the base plate to a boat hull, b) a sealed housing formed integrally with said base plate and extending downwardly therefrom, 1) said housing having a central vertically extending opening with the sides and bottom of said opening being sealed c) a cleat having a top securing portion and a shank portion extending downwardly from said top portion and into said sealed housing for relative vertical movement, d) the opening in said housing and said shank portion being shaped so that no relative rotational movement can take place, e) said shank portion having a vertically elongated slot formed laterally through said shank portion and a laterally extending pin securely carried by said housing and extending through the slot in said shank for relative vertical movement, the length of the slot in said shank being such as to limit the vertical movement of said shank in said housing, and f) resilient means disposed within said housing and engagable with the shank for alternately resiliently maintaining said cleat in its upper and lower positions, and wherein said resilient means is a spring loaded poppit retained in a sealed opening in said housing and engagable with a pair of spaced detents in said shank.

2. A retractable boat cleat assembly having a lower depressed position and an upper exposed position and being moveable between such positions comprising;

a) a base plate having a flange with countersunk openings to receive screws for securing the base plate to a boat hull, b) a sealed housing formed integrally with said base plate and extending downwardly therefrom, 1) said housing having a central vertically extending opening with the sides and bottom of said opening being sealed c) a cleat having a top securing portion and a shank portion extending downwardly from said top portion and into said sealed housing for relative vertical movement, d) the opening in said housing and said shank portion being shaped so that no relative rotational movement can take place, e) said shank portion having a vertically elongated slot formed laterally through said shank portion and a laterally extending pin securely carried by said housing and extending through the slot in said shank for relative vertical movement, the length of the slot in said shank being such as to limit the vertical movement of said shank in said housing, and f) resilient means disposed within said housing and engagable with the shank for alternately resiliently maintaining said cleat in its upper and lower positions, and wherein said resilient means is a spring loaded poppit retained in a sealed opening in said housing and engagable with a pair of spaced detents in said shank and wherein said resilient means is a pair of opposed spring loaded poppits each retained in a sealed opening in said housing and each engagable with a pair of spaced detents in said shank.

* * * * *